US007381246B1

(12) United States Patent
Zhao et al.

(10) Patent No.: US 7,381,246 B1
(45) Date of Patent: Jun. 3, 2008

(54) ELECTROHYDRODYNAMICALLY ENHANCED OIL SEPARATION SYSTEMS

(75) Inventors: Yuan Zhao, Fairfax, VA (US); John Lawler, North Potomac, MD (US); Michael Ohadi, Clarksville, MD (US)

(73) Assignee: Advanced Thermal Environmental Concepts Ltd., College Park, MD (US)

( * ) Notice: Subject to any disclaimer, the term of this patent is extended or adjusted under 35 U.S.C. 154(b) by 345 days.

(21) Appl. No.: 11/211,988

(22) Filed: Aug. 25, 2005

Related U.S. Application Data

(60) Provisional application No. 60/611,450, filed on Sep. 20, 2004.

(51) Int. Cl.
*B03C 3/011* (2006.01)

(52) U.S. Cl. ..... 96/60; 55/DIG. 38; 96/62; 96/70; 96/77; 96/97; 96/98

(58) Field of Classification Search ..... 96/95–100, 96/70, 77, 60–62; 55/DIG. 38
See application file for complete search history.

(56) References Cited

U.S. PATENT DOCUMENTS 895,729 A * 8/1908 Cottrell ..... 95/73
4,496,375 A * 1/1985 Le Vantine ..... 96/66
4,649,703 A * 3/1987 Dettling et al. ..... 60/275
5,024,685 A * 6/1991 Torok et al. ..... 96/43
5,761,752 A * 6/1998 Blake ..... 4/559
6,221,136 B1 * 4/2001 Liu et al. ..... 96/66
6,228,148 B1 * 5/2001 Aaltonen et al. ..... 95/74
6,582,500 B1 6/2003 Ohadi et al.
6,827,761 B2 * 12/2004 Graham ..... 95/32
2001/0020417 A1 * 9/2001 Liu et al. ..... 96/66

FOREIGN PATENT DOCUMENTS

GB 2016305 A * 9/1979 ..... 96/96

* cited by examiner

*Primary Examiner*—Richard L Chiesa
(74) *Attorney, Agent, or Firm*—Rosenberg, Klein & Lee

(57) ABSTRACT

An oil separator for pressurized systems having flowing vapor with entrained oil particles, the separator including an electrically conducting enclosure having an inlet for the oil bearing vapor and a first outlet for the vapor and a second outlet for the separated oil, an electrically conductive screen positioned within the enclosure to receive the entire flow from said vapor inlet, said screen being electrically insulated from the inlet and enclosure, and a high voltage mono-polarity source connected between the screen and the enclosure. A needle-like electrode at the same potential as the enclosure is positioned at the vapor inlet to accentuate the electric field, thereby improving separation.

11 Claims, 3 Drawing Sheets

ELECTROHYDRODYNAMICALLY ENHANCED OIL SEPARATION SYSTEMS

PRIORITY

This Non-Provisional Patent Application claims priority based on a Provisional Patent Application filed 20 Sep. 2004 having Ser. No. 60/611,450 having the same inventors and substantially the same title.

STATEMENT REGARDING FEDERALLY SPONSORED OR FUNDED RESEARCH

This invention was made with Government Support under Contract DAAB15-02-C-0007 and DAAB15-03-C-0007 awarded under the U.S. Army SBIR Program. The Government has certain rights in the invention.

BACKGROUND OF THE INVENTION

Field of the Invention

This invention relates to improved apparatus for separation and removal of liquid, and especially oil, particles from a flowing gas stream within which the liquid particles are entrained. The invention further relates to the application of electrohydrodynamic principles for the purpose.

Background of the Art as Applied to Compression Type Refrigeration

Compression type refrigeration systems employ a mechanical evacuator/compressor to draw refrigerant vapor from an evaporator filled with volatile refrigerant liquid. The withdrawal process lowers the pressure and therefor the temperature in the evaporator, thereby causing the liquid therein to boil and cool the evaporator and the substances around it. The refrigerant vapor drawn from the evaporator by the compressor/evacuator is compressed and pumped to the condenser where circulating air or water cools the hot compressed vapor causing it to condense to a liquid that is, in turn, returned to the evaporator for further refrigeration.

Evacuator/Compressors, always referred to as 'compressors' require lubrication. Historic and present lubricating systems provide a pool of oil in a lower portion of the compressor called the crankcase or sump. Oil from the pump is splashed or pumped onto the compression assembly and bearings. The compression assembly may be of the reciprocating piston-in-cylinder type, scroll, vane or centrifugal-fan type, or other. In substantially all cases oil is entrained with the refrigerant vapor being evacuated and compressed and is discharged to the condenser with the hot vapor. From the condenser much of the oil is transferred with the refrigerant to the evaporator. Unfortunately, when oil is present on the surfaces of a condenser or evaporator, the heat transfer efficiency of either or both is diminished. Further, the oil in the sump can be depleted, thereby risking a potentially disastrous compressor condition of insufficient lubrication.

From the earliest systems to the present, to overcome this problem, many refrigeration systems have included an oil separation device called an oil separator either positioned within the compressor as part of its structure, or positioned external of the compressor in the hot gas conduit from compressor to condenser. The oil separator substantially always includes some way to get the separated oil back to the compressor sump, usually through a float controlled valve or an orifice that allows collected oil to flow back to the sump but restricts the flow of the hot refrigerant vapor from which the oil was removed.

Background of the Art as Applied to Medical or Industrial Gas/Air Supplies

Medical and industrial applications both require air supplies that are substantially free of entrained particles of oils and other liquid contaminants. Medical air and nitrogen supplies typically operate at or slightly above resident atmospheric pressures. By contrast, industrial supplies of air, nitrogen or other gases may operate over a range of pressures, from below atmospheric to well above atmospheric pressure. Therefore, the disclosed apparatuses can be effectively used to separate entrained liquid particles from a gas or vapor having suitable dielectric properties to sustain the applied electric field.

One conventional oil separator is in the form of a vessel having an inner dimension much larger than the dimension of the hot gas conduit. The greater dimension causes the velocity of the refrigerant vapor to become low enough that oil particles that had been entrained in the vapor stream at the higher velocity present in the hot gas conduit, now cease to be entrained and drop to the bottom of the vessel. The oldest separator designs were simply large tanks within which the vapor velocity was so low that oil particles separated from the vapor by gravity. Newer designs involved baffles and direction changes to increase separation by impingement. Separation by impingement means that vapor-borne liquid particles that strike a surface are likely to adhere to the surface rather than becoming re-entrained. Other designs cause the vapor with entrained oil particles to move in a circular path that generates centrifugal forces on the particles. These forces facilitate the movement of the oil particles toward and impingement on a surface, thereby causing separation. Still others use porous filter blocks to cause coalescing, though these tend to exhibit higher pressure drops.

While large oil separators are fairly effective oil separators, they are costly and become more so as the refrigerant pressure levels increase. With the mandated change to non-chlorine bearing refrigerants to protect stratospheric ozone, fluorine bearing refrigerants have become common. These work at higher pressures than similar chlorine compounds mandating heavier construction. Effective separation of oil from refrigerant in a refrigeration system translates into lower oil concentration and therefore more effective heat transfer in the evaporator and condenser of the system, thereby leading to greater thermal efficiency and lower electrical consumption. Effective separation of the oils also helps assure proper oil return to the compressor, thus prolonging the compressor life. Therefore, development of high performance, compact, and commercially viable oil separators is of prime significance in modern refrigeration systems. Further, sales pressures require modern refrigerant components to be both smaller and more thermally efficient, conflicting requirements. In part, it is these factors that have generated the pressure to invent better, smaller and yet more efficient oil separators.

Related Art

Electrostatic air filters have been employed in residential and possibly commercial cooling and heating systems to remove dust and other solid contaminants found in residences and offices. These are positioned in the duct before (on the air inlet side of) the heating or cooling element. Such filters employ oppositely charged high voltage DC electrodes. In one case a charged fine wire grid (electrode) is positioned on the air inlet side of a grounded or oppositely charged set of fin-like plates used as collectors. Dust is charged by the fine charged wires and attracted to and deposits on the grounded plates. Generally an ordinary woven or fiber mesh mechanical air filter is positioned on the air inlet side of the electrostatic device. Periodically the power must be turned off and the woven filter replaced and the grounded plates hosed down or washed.

U.S. Pat. No. 6,582,500, issued 24 Jul. 2003 by Ohadi, et al teaches a device for removing liquid particles from a flowing vapor stream employing a electrohydrodynamic principle plus a swirling device for rotating and agitating the vapor stream. Ohadi '500 teaches an inlet flat charged screen at a first potential and an inlet tube at an opposite, second potential. The oil particles are intended to be charged to the first potential by passage through the inlet screen and separated by contact with the inlet tube. There is no suggestion that the shell is at any specific potential nor that a needle-like electrode is used in any way nor that the inlet charged screen has a cylindrical shape.

OBJECTS AND ADVANTAGES

It is a primary object of the invention to employ electrohydrodynamic forces to improve removal of entrained oil particles from a flowing vapor stream. Other advantages and objects are:

a.) To provide an oil separator design that is applicable to both large and small systems.

b.) To provide such a design that is physically smaller than conventional separators.

c.) To provide such a design that is adaptable to various physical configurations.

d.) To provide such a design that employs electro-hydrodynamic techniques to improve oil separation.

e.) To provide such a design that removes smaller oil particles than former designs of similar size.

f.) To provide a design that is applicable to separation of oils and other liquid and solid vapor borne particles from air, nitrogen as well as a range of commercial and industrial gasses at pressures above and below atmospheric.

Further objects and advantages will become apparent from a consideration of the drawings and the following description.

SUMMARY OF THE INVENTION

An oil separator for vapor flow streams having entrained oil, liquid or solid particles. The separator includes an electrically conducting enclosure having an inlet for the oil bearing vapor, a first outlet for the vapor and a second outlet for the separated oil; An electrically conductive screen is positioned within the enclosure to receive the entire flow from said vapor inlet, said screen being electrically insulated from the inlet and enclosure and charged by a high voltage mono-polarity (DC) source connected between the screen and the enclosure. A needle-like electrode at the same potential as the enclosure is positioned at the vapor inlet to accentuate the electric field, thereby improving separation.

BRIEF DESCRIPTION OF THE DRAWINGS

All the drawings illustrate the invention construction in substantial crossection. Although the tested constructions had both cylindrical screens and shells, the principles of the invention are applicable to non-cylindrical shells and screens and to flat or conical screens. Note also that the drawings are not intended to be to scale. The sizes of various elements shown are selected for clarity and not as a basis for design or construction.

DETAILED DESCRIPTION OF THE PREFERRED EMBODIMENTS

The use of the terms "refrigerant" or "refrigerants" or "vapor" in the following description and in the claims is intended to be shorthand for and apply to vapor streams having entrained contaminants including but not restricted to oils, water, non-oil liquids and solid particles. The use of the term "oil" in the following description and claims is intended to be shorthand for and apply to any liquid or solid particle that is entrained in and desired to be removed from a flowing vapor stream.

Figure 1:
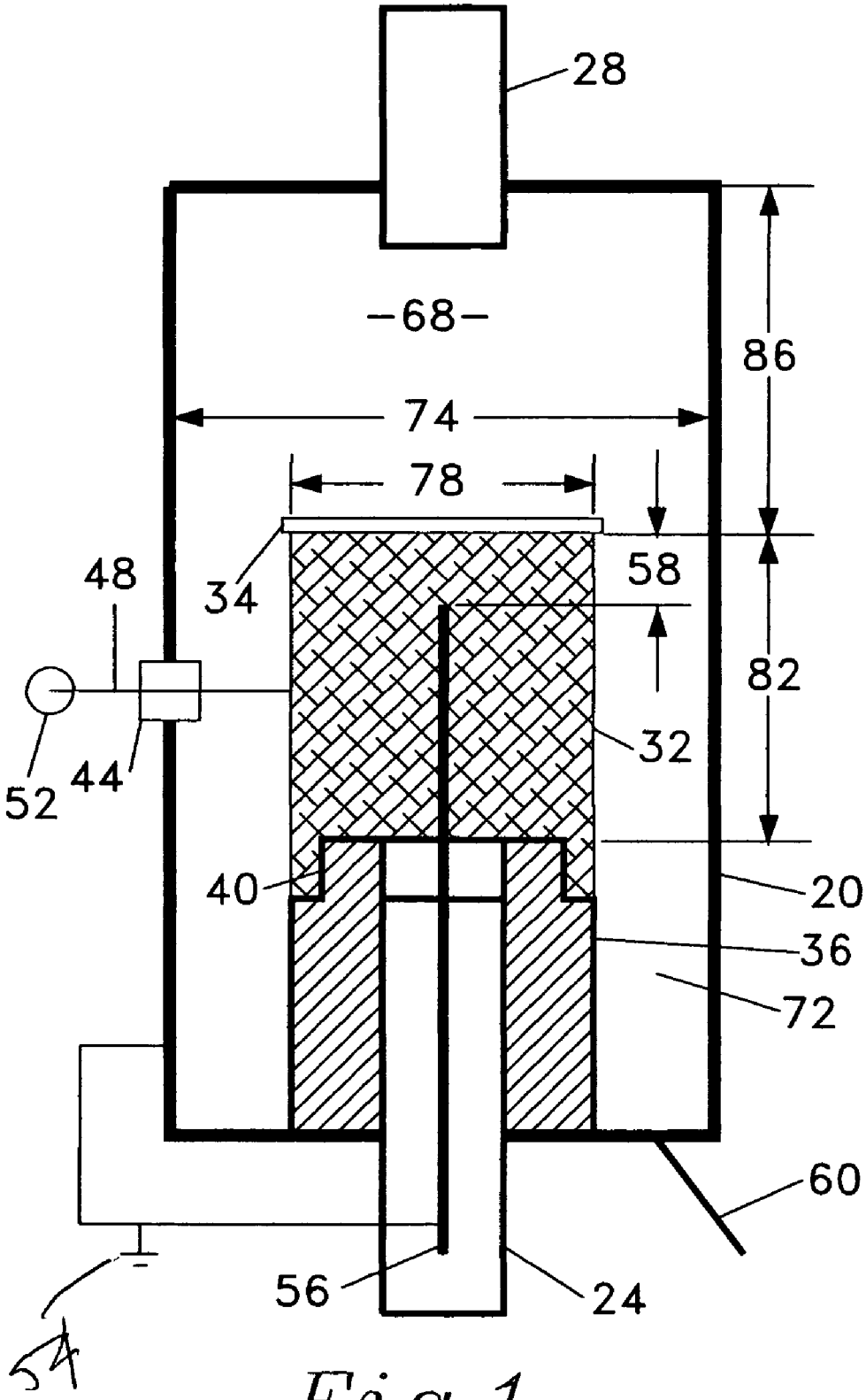
FIG. 1 illustrates a cylindrical single screen version of the invention including a grounded central electrode and an oppositely charged screen.

To achieve a compounding effect, our invention employs three separation mechanisms; inertial or gravitational separation, coalescing and electrohydrodynamic (EHD) separation. Referring now to FIG. 1, there is shown enclosure 20 having inlet 24 for entry of a mixture of vapor and oil. Enclosure 20 is cylindrical. However, the effectiveness of the invention does not depend on the shape of its crossection. Enclosure 20 has an inside diameter 74. Vapor outlet 28 is positioned coaxially with inlet 24. However, a vapor outlet positioned on the periphery of the enclosure 20 will work satisfactorily.

Within enclosure 20 is positioned metallic cylindrical screen 32 having diameter 78. Screen 32 typically is formed with a mesh of 40×40 to the inch which is suitable for typical oils employed in refrigeration systems having refrigerants that are miscible with the oils. Where the oil and refrigerant are immiscible, the oil may have higher viscosity and a coarser mesh such as 20×20 or even 10×10 may be appropriate. Screen 32 is fitted with cap or block 34 to ensure that all vapor and oil flowing into fitting 24 must traverse screen 32. Cap 34 may be electrically insulating or conductive. Screen 32 has an effective length 82 and diameter 78 that typically in the range of 0.3 to 0.7 of the inside enclosure diameter 74. A greater screen diameter has the beneficial effect of providing lower vapor velocity through the screen but higher vapor velocity through the annular space between the screen and the enclosure. A screen diameter 78 about 0.5 the inside diameter 74 of the enclosure 20 has been found highly effective.

Metallic screen 32 is mounted on an electrically insulating bushing 36 that is secured both to the screen 32 and inlet fitting 24. The portion of insulator 36 on which the screen is mounted is formed with ridge 40 for secure screen mounting, though other mounting means are acceptable. Since the assembly may be installed in the vapor discharge from a refrigeration compressor, the temperature of the vapor and oil flowing therethrough may be as high as 300 F. and insulating material 36 must be selected accordingly. Ceramics or thermosetting plastics such as TEFLON (TM-Dupont) are suitable for this purpose.

Screen 32 is electrically charged to a high non-alternating potential or polarity by an external high-voltage power supply, not shown, that is connected to high voltage terminal 52 and conductor 48 in turn connected to screen 32. Conductor 48 traverses the wall of enclosure 20 through feed-through insulator 44. Typical charging voltages are in the range of 8 to 16 kilovolts DC, though the required applied voltage strongly depends on the design of the electrode and the spacing/gap between the charged and the grounded electrode parts. In general higher voltages result in higher electric field strength, thereby enabling capture of smaller oil particulates. However, voltage selection requires a balance between effectiveness of the device in terms of percentage captured (or percentage not captured), pressure drop, electric power consumption and physical dimensions of the system. Higher voltages must be employed with care to prevent arcing that could decompose the refrigerant thereby liberating corrosive and toxic vapors within the system. In systems employing gases or vapors such as air, lower voltages may be appropriate to prevent arc-over. This is especially true where the pressures of the flowing vapor are below atmospheric.

Inlet connection 24 is formed of an electrically conducting material such as metal or copper or copper coated steel or copper coated plastic, for connection to a copper discharge conduit from a compressor. The conduit, inlet connection 24 and enclosure 20 will be at ground electrical potential or polarity as illustrated by ground connection 54. Within, and coaxial with, inlet connection 24 and screen 32 is mounted needle-like electrode 56 that is at ground potential or polarity, the same as the inlet fitting and enclosure 20. Where cap 34 is electrically conductive, the end of electrode 56 must be positioned within screen 32 at a distance 58 from cap 34 where distance 58 is selected sufficiently great to prevent arcing from the electrode to the cap. Typically distance 58 is greater than 0.5 times the screen diameter 78. The purpose of electrode 56 is to provide an intense electric field at its inner tip to improve charging of the entrained oil droplets to ground potential whereby they will be most effectively attracted to and retained by charged screen 32 from which they drain by gravity into oil reservoir 72. Those oil particles that traverse charged screen 32 become charged to the screen potential and on leaving the screen into space 68 are attracted to and coalesce on the interior of enclosure 20 from which they drain by gravity into oil reservoir 72. Collected oil in reservoir 72 is returned to the compressor via oil outlet 60. While no mechanism is shown for doing this, float valves and other controls are available for this purpose. In applications where the amounts of oil to be collected are small, the oil outlet 60 or 114 and 144 may be omitted or a sponge or other absorbent material substituted and the collected oil physically removed periodically.

Within shell 20 are two volumetric spaces having different functions. Space 68 is directed to providing lower vapor velocity for the purpose of allowing particles of oil to physically separate from the vapor by either gravity or centrifugal force. Space 68 has an axial length 86. Space 72 is intended to provide a reservoir for separated oil and therefore is subjected to a lower vapor velocity for the purpose of reducing re-entrainment of collected oil to be drained back to the compressor via oil outlet 60. Note also that the electrical field strength in the space 68 is much weaker than the field strength in space 72 due to the increased distance between the electrodes. Since liquid particles have much greater permitivity than gas, the particles tend to move toward the space with higher electrical field strength. As a result, the unevenly distributed electrical field facilitates holding separated oil particles in space 72 thereby preventing them from entering space 68.

In a second embodiment of the invention, oil bearing vapor from the compressor discharge is directed into fitting 28, now the enclosure inlet. Gross separation of entrained oil then occurs in space 68. In the reversed flow arrangement one or more grounded electrodes 56 are positioned in space 68 to intensify the electric field affecting entrained oil droplets. Remaining entrained oil particles charged to ground potential are then attracted to and coalesce on charged screen 32 and drain therefrom into space 72 for transfer back to the compressor through oil outlet 60.

Figure 2:
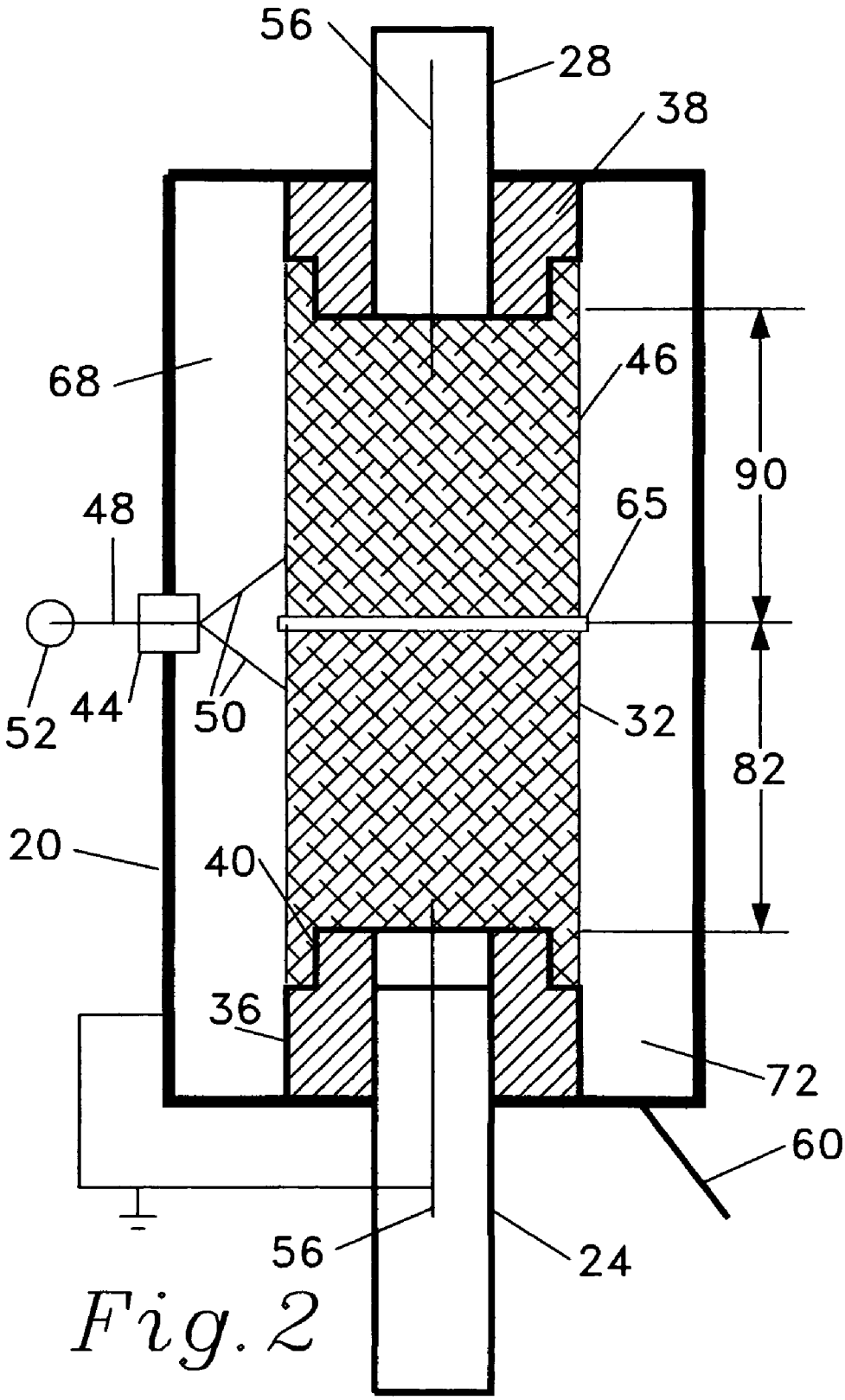
FIG. 2 shows a dual screen embodiment having a central inlet electrode and both inlet and outlet charged screens.

Referring now to FIG. 2 there is shown enclosure 20 with inlet 24, outlet 28, inlet screen 32 and outlet screen 46 supported by outlet insulator 38. Block or cap 65 is provided to ensure that the vapor entering the separator via fitting 24 must traverse inlet screen 32 and, in turn, outlet screen 46. The two screens are effectively in flow series. The two screens are intended to both be at the charged or high voltage potential. If cap 65 is not conductive, then electrical connection means such as high tension connectors 50 must be employed to provide the high voltage to both. Inlet grounded linear electrode 56 is positioned centrally within inlet 24 and inlet screen 32. There the intense electric field generated between the charged screen and tip of the grounded linear wire electrode 56 will effectively charge entering entrained oil particles.

Inlet screen 32 has length 82. Outlet screen has length 90. The area of the screens is proportional to their lengths. Typically the inlet screen that is subject to the highest oil concentration is selected to have a smaller area and therefore a higher vapor velocity. The outlet screen, subject to reduced oil particle concentration in the vapor, is selected to have a greater area and a lower vapor velocity. Typical inlet/outlet screen area ratios are between 0.5 to 2.0 but an inlet to outlet area ratio of 0.8 has been found effective. In FIG. 1 where there is no outlet screen, the ratio of 0.8 of the length 82 of the inlet screen 32 to the length 86 of the unscreened separating chamber 68 has also been found to be effective. Depending on the specific application, however, ratios of length 82 of inlet screen 32 to length 86 of separating chamber 68 up to about 1.5 may prove effective, depending on specific vapor flow and viscosities. In FIG. 2 oil drops charged to ground potential by electrode 56 are either attracted to and coalesce on screen 32 and drain into space 72 or are charged to high potential and traverse screen 32 with the vapor flow. Most of these charged droplets are then attracted to and coalesce on walls of enclosure 20. Further, the remaining charged particles are repelled by outlet screen 46 and are finally attracted to the oppositely charged inner wall of enclosure 20.

In another embodiment of the invention, axial grounded electrodes 56 are provided within both the inlet and outlet fittings so the flow can be in either direction.

Figure 3:
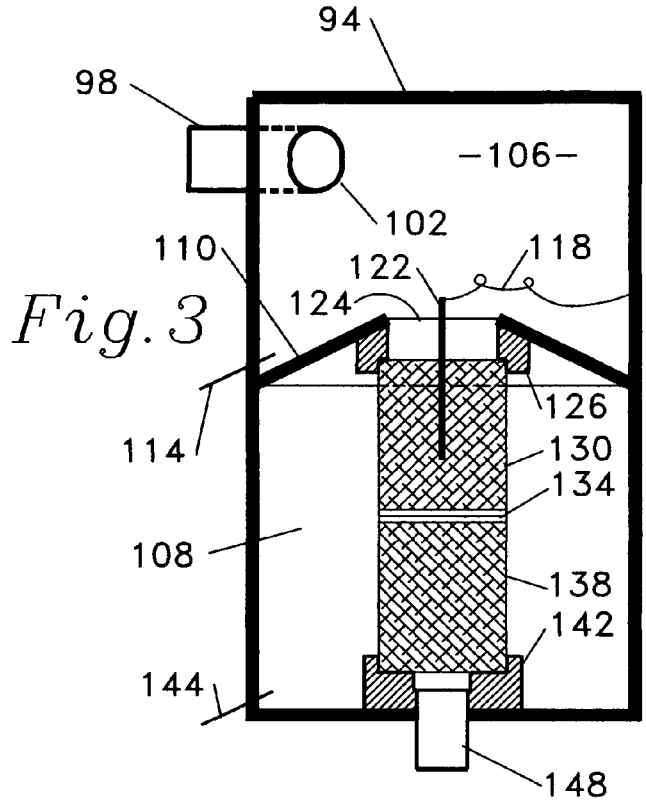
FIG. 3 displays a two stage separator having an upper centrifugal separator and a lower dual charged screen separator.

In FIG. 3 there is provided enclosure 94 having upper inlet 98 that provides tangential vapor-oil entry at 102 to upper chamber 106 where larger oil particles separate from the vapor stream both by centrifugal and gravitational forces. Separated oil flows down the inside walls of upper chamber 106 and collects on conical baffle 110 from which the oil is drained at outlet 114. In an alternative construction, a drain hole or internal outlet is provided at a low point in baffle 110 so separated oil can flow into lower chamber 108 and there combine and drain from outlet 144 with oil separated by the electrohydrodynamic construction. Baffle 110 has centrally positioned opening 124 through which vapor and remaining oil particles leave upper chamber 106 and enter lower chamber 108.

Within opening 124 is positioned centrally located electrode 122 grounded by conductor 118. Inlet charged screen 130, conductive cap 134 and lower charged screen 138 are positioned in flow communication with opening 122 and insulated from the grounded enclosure by inlet insulator 126 and outlet insulator 142. Remaining oil particles, not having been separated from the vapor stream in upper chamber 106. now traverse inlet and outlet charged screens 130 and 139. This traverse, as described in connection with FIGS. 1 and 2, cause oil particles having assumed ground charge by traversing the intense electric field generated by central grounded electrode 122 to be attracted by and deposited on inlet charged screen 130. Undeposited oil particles are now at charged potential and are repelled from outlet charged screen 138 and caused to deposit on the walls of chamber 108. Collected oil is drained from lower oil drain connection 144 and substantially oil-free vapor leaves the separator via outlet connection 148.

Figure 4:
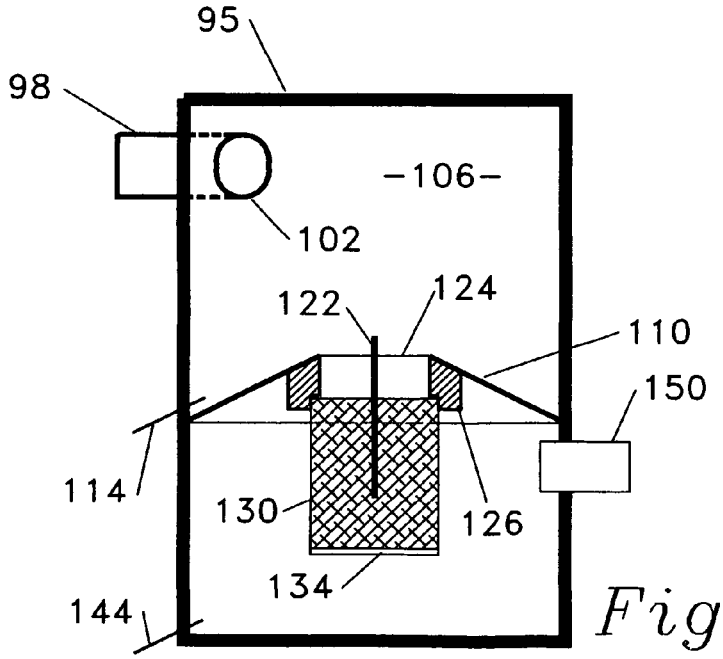
FIG. 4 is similar to FIG. 3 with the exception that a single charged screen is employed.

In FIG. 4 is shown a simpler single charged screen version of the two-stage separator of FIG. 3.

From the foregoing description, it can be seen that the present invention comprises an unusual and unobvious system and construction for removing entrained oil, other liquids or solid particles from a flowing vapor stream including streams of refrigerants, air, nitrogen and other domestic and industrial gases having dielectric properties that can sustain an applied electric field of the sort discussed in this application. It will be appreciated by those skilled in the art that changes could be made to the embodiments described in the foregoing description without departing from the broad inventive concepts thereof. It is understood, therefore, that this invention is not limited to the particular embodiment or embodiments disclosed, but is intended to cover all modifications which are within the scope and spirit of the invention as claimed and equivalents thereof.

We claim:

1. An oil separator comprising electrically conductive enclosure means for receiving vapor and entrained oil particles, said means having an inlet for receiving said vapor and oil, a first outlet for discharging vapor, an electrically conducting screen positioned between the enclosure means inlet and the first outlet, means for applying high voltage constant polarity potential between said enclosure means and said screen whereby the screen has a first polarity and the enclosure a second polarity, said screen being in the form of a cylinder having an open end and a closed end and having an interior and an exterior, said cylinder being positioned to receive the vapor-oil mixture from the enclosure means inlet into its interior through its open end.

2. An oil separator as recited in claim 1, further providing a linear electrode axially positioned within the cylindrical screen and spaced from it, said linear electrode being at the second polarity.

3. An oil separator as recited in claim 2, further providing a volume to receive separated oil and a second outlet for discharging said separated oil.

4. An oil separator as recited in claim 2 further including a second screen having first polarity, said second screen being positioned between the first screen and the first outlet.

5. An oil separator as recited in claim 4 further providing that said second screen is in the form of a cylinder having an open end, a closed end, an exterior and an interior, said second cylinder being positioned to receive to its exterior flow from the first cylinder and to discharge to the first outlet said flow through its open end.

6. Oil separator means for separating oil from refrigerant vapor and for discharging oil and refrigerant separately, said means comprising, an electrically conductive enclosure having an enclosure inlet, first and second chambers and an enclosure outlet, said enclosure inlet opening into the first chamber wherein oil is separated from said vapor;

a first chamber vapor outlet for discharging vapor into the second chamber, said first chamber outlet being also the second chamber vapor inlet, and a first chamber oil outlet for discharging oil separated from the vapor in the first chamber; an electrically conducting screen positioned between the second chamber inlet and the enclosure outlet, means for applying high voltage constant polarity potential between said enclosure means and said screen whereby the screen has a first polarity and the enclosure a second polarity said screen being in the form of a cylinder having an open end and a closed end and having an interior and an exterior, said cylinder being positioned to receive the vapor-oil mixture from the second chamber inlet into its interior through its open end.

7. Oil separator means as recited in claim 6 further providing a linear electrode axially positioned within the cylindrical screen and spaced from it, said linear electrode being at the second polarity.

8. An oil separator as recited in claim 7 further including a second screen having first polarity, said second screen being positioned between the first screen and the enclosure outlet.

9. An oil separator as recited in claim 8 further providing that said second screen is in the form of a cylinder having an open end, a closed end, an exterior and an interior, said second screen being positioned to receive to its exterior flow from the first screen and to discharge to the enclosure outlet said flow through its open end.

10. An oil separator comprising an electrically conductive enclosure for receiving vapor and oil particles entrained therewith, said enclosure having an inlet for receiving said vapor and oil, an outlet for discharging vapor, an electrically conducting screen in the form of a cylinder having an interior and an exterior, said screen positioned between said inlet and said outlet, said cylinder being positioned to receive into its interior the vapor-liquid mixture from the enclosure inlet, means for applying high voltage constant polarity potential between said enclosure means and said screen whereby the screen has a first polarity and the enclosure a second polarity and a linear electrode axially positioned within the cylindrical screen and spaced from it, said linear electrode being at the second polarity.

11. An oil separator as recited in claim 10, further providing means for receiving and collecting separated oil and further providing a second outlet adapted and positioned to discharge said collected separated oil.

* * * * *